US005821467A

United States Patent [19]

O'Brien et al.

[11] Patent Number: 5,821,467

[45] Date of Patent: Oct. 13, 1998

[54] FLAT-TYPE COMMUNICATION CABLE

[75] Inventors: Douglas D. O'Brien; Thomas L. Rodeghero; Robert D. Kenny, all of Richmond, Ind.

[73] Assignee: Belden Wire & Cable Company, Richmond, Ind.

[21] Appl. No.: 714,801

[22] Filed: Sep. 11, 1996

[51] Int. Cl.[6] ..... H01B 7/04

[52] U.S. Cl. ..... 174/117 F; 174/117 AS

[58] Field of Search ..... 174/113 R, 117 F, 174/117 AS, 121 A

[56] References Cited

U.S. PATENT DOCUMENTS

| | | | |
|---|---|---|---|
| 2,804,494 | 4/1957 | Fenton | 174/113 AS |
| 4,454,378 | 6/1984 | Neuroth | 174/117 F X |
| 4,707,568 | 11/1987 | Hoffman et al. | 174/117 F X |
| 4,801,764 | 1/1989 | Ohlhaber | 174/117 F X |
| 5,132,488 | 7/1992 | Tessier et al. | 174/34 |
| 5,179,251 | 1/1993 | Mullin et al. | 174/117 F X |
| 5,202,946 | 4/1993 | Hardin et al. | 385/109 |
| 5,486,654 | 1/1996 | Hanak et al. | 174/117 F X |
| 5,514,837 | 5/1996 | Kenny et al. | 174/121 A X |
| 5,606,151 | 2/1997 | Siekierka et al. | 174/113 R |

*Primary Examiner*—Kristine L. Kincaid
*Assistant Examiner*—Marc D. Machtinger
*Attorney, Agent, or Firm*—Laff, Whitesel, Conte & Saret, Ltd.

[57] ABSTRACT

The present invention relates to a flat-type communication cable for carrying frequencies in excess of 4 Mhz. The cable has a plurality of longitudinally extending conductor passageways positioned side-by-side and preferably at least four passageways such that there are two end longitudinal passageways and a plurality of side-by-side intermediate passageways. Each passageway has a longitudinally extending opening which opens to an adjacent passageway. There are twisted pair conductors loosely located in each of the passageways with not more than one twisted pair conductor being in each passageway. Each twisted pair conductor has a cross-sectional envelope area less than a cross-sectional envelope area of the passageway in which the twisted pair is contained.

16 Claims, 2 Drawing Sheets

FLAT-TYPE COMMUNICATION CABLE

The present invention relates to unshielded communication cables and more particularly to a flat-type crescent shaped communication cable.

Various types of unshielded cables being utilized on computer systems contain 4 twisted pair conductors. The cable is restricted typically to 24 AWG conductors, a maximum of 0.0395" insulation, and an overall Average cable OD of 0.250". Further, flame test requirements also restrict the use of what type of compounds can be utilized within the cable. Because of these restrictions, twisted pair cables are often bundled together into 4 pair groups. These typically have no spacing between the individual twisted pair units. Therefore, reduction of crosstalk is limited to the selection of suitable twist lengths, where tighter twists usually exhibit enhanced crosstalk characteristics. Attenuation is limited to conductor size, typically in the range of 0.019" to 0.023" in diameter. A problem exists where tighter twisted pair lays degrade attenuation characteristics. Hence, a trade off for good crosstalk is made by accepting the poorer attenuation performance of tightly twisted pairs.

It is therefore an object of this invention to provide a flat-type communication cable having a plurality of spaced twisted pair cables and which is flexible to allow relatively easy installation by installers.

It is another object of the present invention to provide a crescent shaped flat-type cable comprising a jacket having an upper convex surface, a lower concave surface and a pair of arcuate sides, said jacket having a plurality of longitudinally extending conductor passageways, said passageways being positioned side-by-side, each passageway having a longitudinally extending opening which forms an opening for adjacent passageways; not more than one twisted-pair conductor in each passageway; and each twisted pair conductor having a cross-sectional circular envelope which has an area less than an area of a cross-sectional envelope of the passageway in which it is located.

It is further an object of the present invention to provide a flat-type communication cable for carrying frequencies in excess of 4 Mhz comprising a plurality of longitudinally extending conductor passageways, said passageways being positioned side-by-side, each passageway having a longitudinally extending opening which opens to an adjacent passageway, a twisted pair conductors loosely located in said passageways with not more than one twisted pair conductor being in each passageway; each twisted pair conductor having a cross-sectional envelope area less than a cross-sectional envelope area of the passageway in which said twisted pair is contained.

SUMMARY OF THE INVENTION

The present invention provides a flat-type cable and preferably a crescent shaped flat-type cable having a jacket having an upper convex surface, a lower concave surface and a pair of arcuate sides, said jacket having at least four longitudinally extending conductor passageways, said passageways being positioned side-by-side such that there are two end longitudinal passageways and a plurality of side-by-side intermediate passageways, each passageway having a longitudinally extending opening which forms an opening for adjacent passageways; not more than one twisted-pair conductor in each passageway; each twisted pair conductor having a cross-sectional circular envelope which has an area less than an area of a cross-sectional envelope of the passageway. Preferably the jacket has varying wall thickness and the twisted pair conductors are unshielded.

The phrase, multi-conductor flat-type cable refers to cables having preferably four pairs of insulated conductors with each pair being spaced a predetermined distance apart between adjacent conductor pairs and all of the pairs being covered by an appropriate common jacket. Each of the insulated conductor pairs are loosely within the jacket and are not bonded to the jacket. Each of the insulated conductor pairs has an appropriate insulation. The insulation for all of the insulated conductor pairs may be the same. However, it is preferred that at least one of the insulated conductor pairs has a non-fluorinated polymer insulation. The insulated conductor pairs are preferably twisted pair conductors having a common insulation and the jacket is a crescent shaped solid or foam jacket with a plurality of side-by-side longitudinal passageways.

The present invention and advantages thereof will become more apparent upon consideration of the following detailed description when taken in conjunction with the accompanying drawings.

DETAILED DESCRIPTION OF THE INVENTION

The present invention provides a flat-type cable with a jacket having a plurality of twisted pair passageways—usually four. In each passageway, there is loosely contained a twisted pair conductor. Each of the twisted-pair conductors are spaced from each other and can have a relatively long lay length. The longer lay lengths enable the invention to utilize relatively thin wall foam insulations without crushing the cellular cavities created during the foaming process. In the present invention, three out of the six possible crosstalk combinations in a four pair cable are improved over the generally used cylindrical bundled four pair cable.

The flat-type cable of the present invention has a width of about 0.250 inches to about 0.360 inches and the twisted pair lay lengths range from about 0.4 inches to about 4.0 inches. The twisted pair conductors are arranged in a generally parallel side-by-side configuration. Each insulated conductor of each twisted conductor pair has a diameter of not more than 0.0395 inches. Each of the longitudinal passageways have an internal longitudinal opening extending the length of the cable jacket. The passageways restrict the movement of adjacent twisted-pair conductors. The relative positions of each twisted-pair conductor remains within 0.9 times X after the flat cable has been bent in a Semi-circle along the longitudinal axis around a mandrel measuring 0.3 times the width of the cable. X is the distance between two adjacent twisted pair conductor center lines before the cable is bent.

The cable is generally used for digital or analog communication cables having frequencies from about 1.0 to 500 MHz and higher and mainly above 4 MHz.

The passageways in the cable are sufficiently large such as to create pockets of air between the twisted-pair conductor and the walls of the passageway. The twisted-pair conductors are loose within each passageway—not bonded to the jacket.

Figure 1:
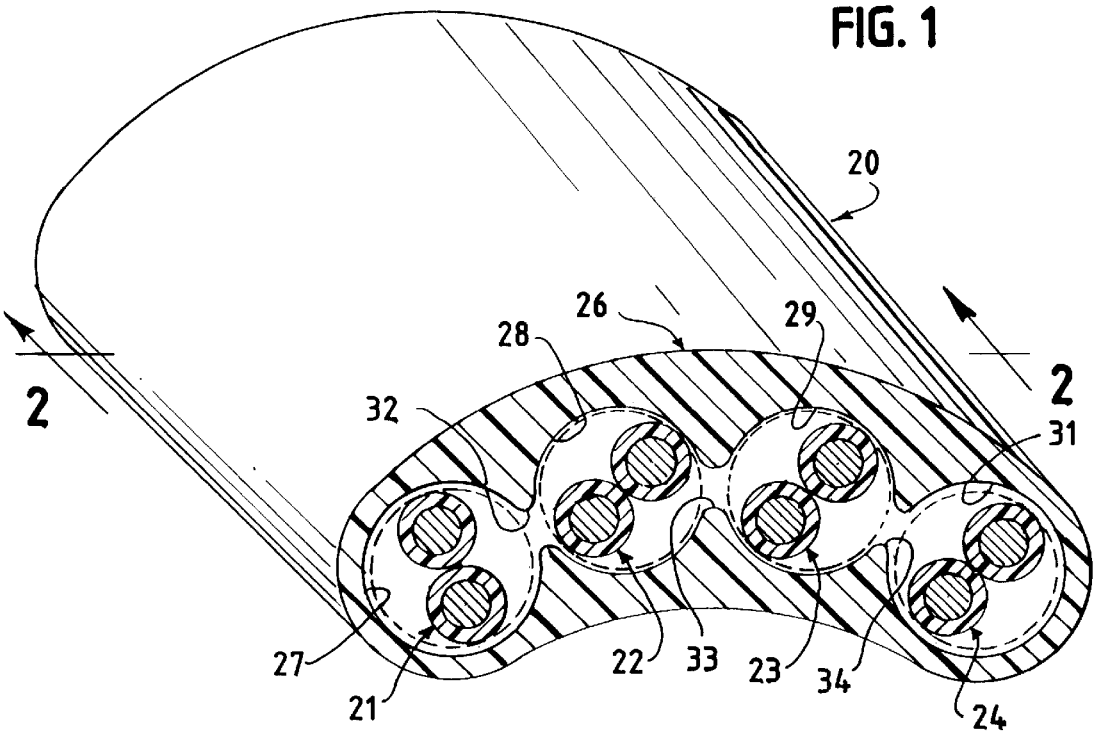
FIG. 1 is a side perspective view of the flat-type cable of the present invention.
Figure 2:
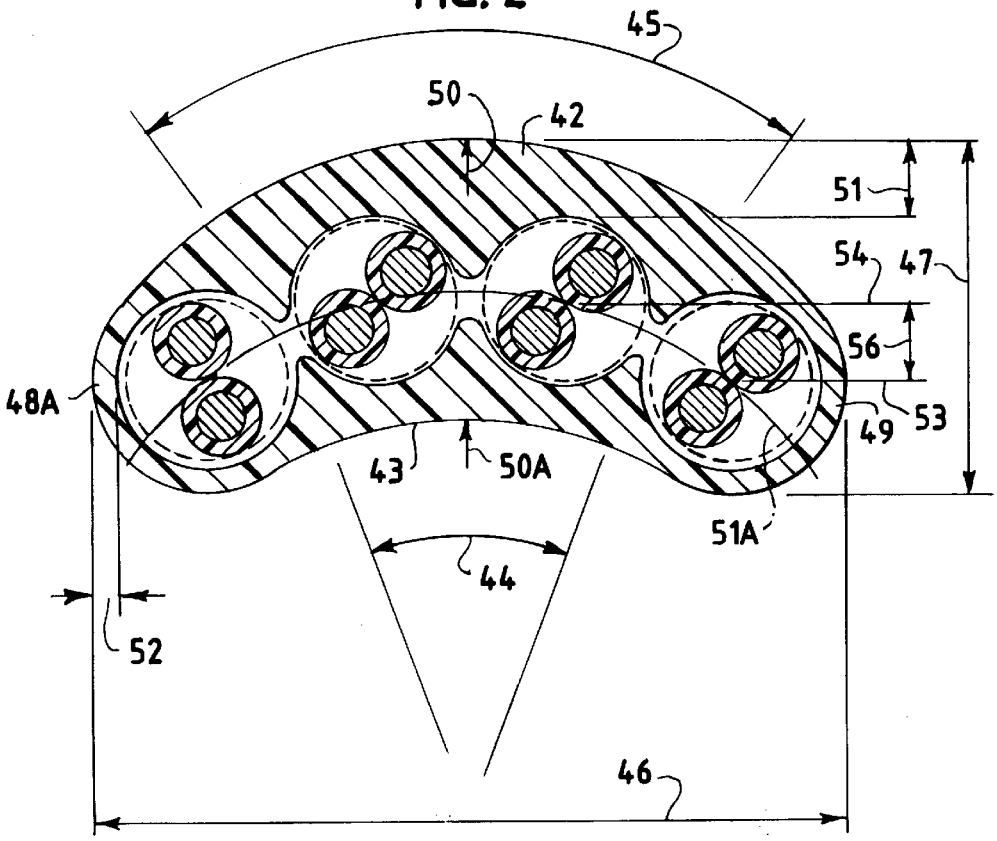
FIG. 2 is a cross-section taken along lines 2—2 of FIG. 1.

Referring to FIGS. 1 and 2 there is shown a flat crescent cable 20 of the present invention. The flat crescent cable 20 shown has four generally equivalent sized twisted pair conductors 21, 22, 23, and 24 in a side-by-side parallel configuration. The first twisted-pair conductor 21 being on one side of the cable and the fourth twisted pair conductor 24 being on the opposite side of the cable. The cable is covered by a single common jacket 26.

The jacket 26 is a flat-type jacket with a generally crescent shaped cross-section. The interior of the jacket is divided into four side-by-side longitudinally extending twisted pair conductor passageways 27, 28, 29 and 31 that extend the entire length of the cable 20. Each passageway opens into an adjacent passageway by longitudinally extending openings 32, 33 and 34. Opening 32 provides an opening between adjacent longitudinal passageways 27 and 28; opening 33 provides an opening between adjacent longitudinal passageways 28 and 29; and opening 34 provides an opening between adjacent longitudinal passageways 29 and 31. The passageways may be any shape desired—i.e. cylindrical, non-cylindrical, a combination of these multi-sided, etc. FIGS. 1 and 2 show non-cylindrical passageways and FIG. 3 shows cylindrical passageways.

The twisted pairs 21, 22, 23 and 24 are loosely within the respective passageways 27, 28, 29 and 31 and are not bonded to the passageways. The end passageway 27 is sized such that when it contains twisted pair conductor 21 it has a volume of air greater than the volume of air of passageway 28 containing twisted pair conductor 22. The other end passageway 31 containing twisted pair conductor 24 is sized to have a volume of air greater than the volume of air of passageway 29 containing twisted pair conductor 23. The volume of air in passageway 27 with the twisted pair conductor 21 is preferably at least 1.2 times the volume of air of intermediate passageway 28 when it contains twisted pair conductor 22. If necessary, the volume of the end passageways 27 and 31 is increased by providing a longitudinal open pocket in the walls of the end passageways. The air pockets may be formed by using irregular shaped end passageway walls.

Figure 4:
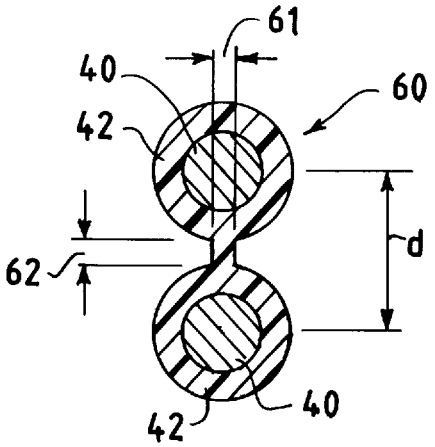
FIG. 4 is an enlarged cross-section of a bonded twisted pair conductor used in the present invention.
Figure 5:
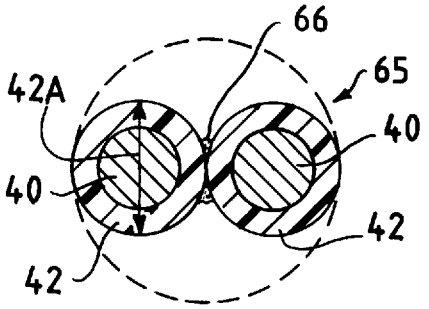
FIG. 5 is an enlarged cross-section view of another bonded twisted pair conductor used in the present invention.

The term twisted pair conductor as used herein refers to two individual insulated conductors that are joined or separated and are twisted about each other. Each of the individual insulated conductors has a suitable electrical conductor surrounded by a suitable insulation. FIGS. 4 and 5 as hereinafter described illustrate two types of joined insulated conductor used to form a twisted pair conductor.

Figure 3:
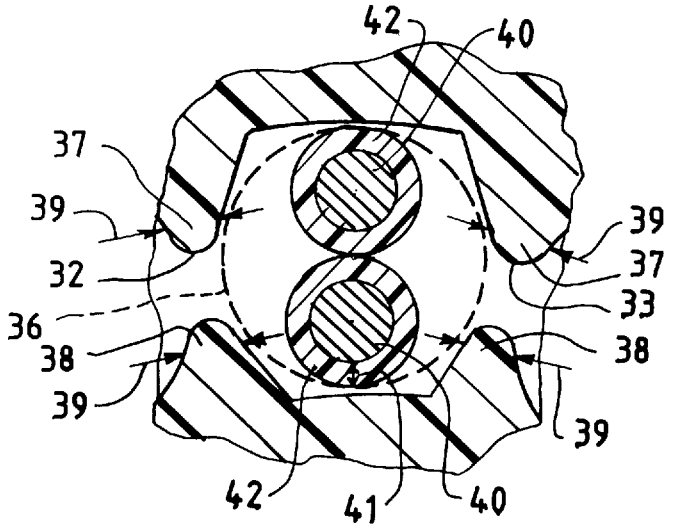
FIG. 3 is a partial enlarged section of FIG. 2.

It is desirable to have each of the two end passageways 27 and 31 enclose about 80 to 95% and preferably about 87% to 93% of each of the twisted-pair cylindrical envelope 36 (FIGS. 3 and 4). The two intermediate passageways 28 and 29 between the end passageways 27 and 31 enclose about 60 to 90% of the twisted pair envelope 36 and preferably 75 to 87%. The end passageways 27 and 31 preferably do not enclose less than 83% of the twisted-pair cylindrical envelope 36 and the inner or intermediate passageways 28 and 29 preferably do not enclose less than 75% of the twisted-pair cylindrical envelope 36.

Another way of considering this is to take a perpendicular cross-section through the cylindrical envelope 36 which shows a circle having 360° circumference. Thus, each of openings 32, 33 and 34 would only expose an arc of about 18° to about 70° and preferably between about 25° to about 47° of the circular envelope.

In another embodiment, the width or height of each opening is less than 75% of the diameter of one of the conductors of a twisted pair conductor in the passageway. If the opening is between intermediate passageways, the opening is less than 75% of the diameter of the smallest single conductor of the twisted-pair in either of the two adjacent passageways. That is, referring to FIG. 5 for illustrative purposes, if the diameter 42A of the single conductor 42 is 0.04 inches, the opening will be 0.03 inches or less.

Each of the longitudinal twisted-pair conductor passageways 27, 28, 29 and 31 has a cross-sectional profile area that is larger than the cross-sectional profile area of the twisted-pair conductor cylindrical envelope 36 to provide air pockets between the twisted pair conductors and their respective passageways.

Referring to FIG. 3, each of the openings 32, 33 and 34 is formed by a pair of opposite projections 37 and 38 that extend the length of the jacket and project inwardly. Each projection is sized to provide a stiffness that resists allowing the twisted-pair conductor in one longitudinal passageway passing through to an adjacent longitudinal passageway. The configuration shown is a triangular-type cross section with a mid thickness 39 of the projections 37 and 38 generally at least 50% greater than the thickness 41 of the twisted-pair conductor insulation 42.

The separate longitudinal passageways for each twisted-pair conductor aid in increasing the spacing and keeping the twisted pair conductors separated from one another. Each twisted-pair conductor has restricted movement and tends to stay in its own space or longitudinal passageway. This restriction of movement between adjacent twisted-pair conductors reduces crosstalk susceptibility between active to passive twisted-pair conductors. Without the projection, the twisted-pair conductors would be free to move amongst one another during manufacture and/or installation which ultimately degrades the electrical characteristics of the installed cable 20.

When referring to FIG. 2, the jacket 26 for our twisted-pair conductors has a relatively continuous outer surface with central curved convex outer surface 42 and a curved concave bottom surface 43 which have respective arcs 45 and 44 separating the two inner or intermediate passageways. The jacket 26 is prepared from suitable foamed or unfoamed polymers and one of the preferred materials is a jacket material, such as polyvinyl chloride, which may be partially foamed with 10%–15% voids. The width 46 of the cable 26 is about 0.25 to 0.36 inches.

The thickness or height 47 of the cable 20 is in the range of 0.10 inches to about 0.16 inches and preferably between about 0.12 to 0.14 inches.

The thickness of the jacket 26 not counting the projections, varies between about 0.010 inches to about 0.040 inches. The thickness of the upper central portion is the largest thickness of the jacket with the center portion 47 of the jacket convex surface 42 having the greatest thickness and the sides 48 and 49 of the jacket having the smallest thickness. The thickness of the bottom concave portion is less than the thickness of the upper convex portion and greater than the thickness of the sides 48 and 49. The ratio of the upper to the bottom thickness is in the range of between about 1.1 to 2 and preferably about 1.2.

The center thickness 51 which does not include the length of the projections is about the same size as the diameter of a single insulated conductor and will generally be from about 0.030 to about 0.040 inches. The thickness 52 of the sides 48 and 49 will be from about 0.010 to about 0.020 inches.

The jacket and its crescent shape enhances flexibility of the cable and preserves twisted pair location. This shape causes the cable to curl towards its minor axis when a bending force is applied to the cable. This effect increases the bend radius at least 2 fold when compared to cables of typical flat design since the minor axis is less than half that of comparable designs. Additionally, this curling effect takes stress off the pairs themselves, reducing the possibility of pair crossover as seen with conventional flat configuration designs.

The varying jacket thickness also provides an advantage. The curl effect gained by the crescent shape is further enhanced by increasing the jacket thickness in the center portions of the cable 26. With the increased center thickness, the jacket is able to hold its shape. Due to the shape of the cable, each of the passageways 27, 28, 29 and 31 have walls with varying thickness.

The radius 50 of the convex surface 42 is about 0.08 inches to 1.05 inches and preferably about 0.22 inches. The radius 50A of the concave surface 43 is about 0.15 inches to 1.1 inches and preferably about 0.32 inches.

The twisted pair conductors have an arc 51 A passing through the center points of the twisted pair conductors. The arc 51A has a radius of curvature of from about 0.08 inches to 1.05 inches and preferably about 0.22 inches.

The inner twisted-pair conductors 22 and 23 are spaced above the side twisted-pair conductors 21 and 24. That is when a transverse center line 53 is drawn through the cross-sectional connecting points of the side twisted-pair conductors 21 and 24 and a transverse center line 54 is drawn through the cross-sectional connecting points of the inner twisted-pair conductors 22 and 23, the distance 56 between the two center lines within the jacket is from about 0.020 to about 0.060 inches.

The conductors 40 may be constructed of any suitable material, solid or strands, of copper, metal coated substrate, silver, nickel, aluminum, steel, alloys or a combination thereof. The dielectric may be suitable material used in the insulation of cables such as polyvinylchloride, polyethylene, polypropylene or fluoro-copolymers (such as TEFLON, which is a registered trademark of DuPont), cross-linked polyethylene, rubber, etc. Many of the insulations may contain a flame retardant. The thickness of the insulation or dielectric layer 42 is in the range of from about 0.00025 to about 0.0150 inches.

It is preferred that at least one of the twisted-pair conductors has a non-fluorinated polymer insulation. It is preferred that the passageways containing the twisted pair conductor with the non-fluorinated polymer insulation have the greatest wall thickness. The greater wall thickness acts as a flame suppressant. Therefore in the embodiment shown in FIGS. 1 and 2 the non-fluorinated twisted pair conductors would be either or both of twisted pair conductors 22 and 23 in passageways 28 and 29 respectively. The present construction of the cable allows the use of twisted-pair conductors having cellular insulation. Longer lay lengths can be used with the twisted pair conductors to greatly reduce the compression forces encountered with tightly twisted—i.e., short lay lengths. This allows the benefit of thin wall foam dielectrics which improve attenuation while reducing material usage. Additionally, reduction in insulation usage through foaming allows for more types of materials to be utilized while maintaining flame and electrical characteristics. Further, foaming reduces overall size of insulated singles, which is advantageous with respect to fitting in standard industry connectors and to realizing a truly flexible construction.

FIG. 4 shows one type of joined twisted-pair conductor 60 that can be used. The twisted-pair conductor has two solid, stranded or hollow conductors 40. The conductors are solid metal, a plurality of metal strands, an appropriate fiber glass conductor, a layered metal or combination thereof. Each conductor 40 is surrounded by a respective cylindrical dielectric or insulation layer 42. Each of the conductors 40 is disposed centrally within and thus substantially concentric with the corresponding insulation 42. The conductors 40 may, if desired, adhere to any degree against the inner walls of the respective insulation 42 by any suitable means, such as by bonding, by heat or adhesives to prevent relative rotation between the conductor 40 and insulation 42.

The insulation 42 is common for both conductors 40 as shown in FIG. 4 where the insulations 42 are integral with each other and are joined together along their lengths in any suitable manner. As shown, the joining means is a solid integral web which extends the length of each conductor from the diametric axis of each insulation. The width 62 of the web is in the range of from about 0.00025 to about 0.0150 inches. The thickness 61 of the web is also in the range of from about 0.00025 to about 0.0150 inches. The web thickness is preferably less than the thickness of the dielectric layer. The web width is preferably less than the thickness of the dielectric layer.

The dual conductors surrounded by the dielectric(s) layer are twisted to form a twisted-pair conductor. The variation in the distance between the centers of adjacent conductors, hereinafter referred to as the center-to-center distances, along the twisted pair cable is very small. The center-to-center distance d at any one point along the twisted pair cable is predetermined.

FIG. 5 illustrates another twisted-pair conductor 65 that is joined or bonded together substantially along its entire length by an appropriate adhesive 66. Instead of an adhesive, the adjacent dielectrics can be bonded together by causing material contact while the dielectrics are at elevated temperatures and then cooling to provide a joined cable having no adhesive. The non-adhesive bonding provides an integral common dielectric for the two conductors 40.

The flat-type cable of the present invention preferably has at least one non-fluorinated polymer insulated twisted-pair and is especially useful as a Category 5 cable and which will pass the UL 910 flame test.

The foregoing description is for purposes of illustration only and is not intended to limit the scope of protection accorded the invention. The scope of protection is to be measured by the following claims, which should be interpreted to give us the broadest protection possible due to inventive contribution.

We claim:

1. A crescent shaped flat-type cable comprising:

a jacket having an upper convex surface, a lower concave surface and a pair of arcuate sides, said jacket having a plurality of longitudinally extending conductor passageways and said passageways being positioned side-by-side to form a plurality of pairs of adjacent passageways;

a plurality of longitudinally extending openings, each of said openings between each of said pairs of adjacent passageways;

a plurality of twisted-pair conductors, a different one of said plurality of twisted-pair conductors disposed in a different one of said extending conductor passageways, not more than one of said twisted-pair conductors in each of said different passageways; and each twisted pair-conductor of said plurality having a cross-sectional circular envelope which has an area less than an area of a cross-sectional envelope of the conductor passageway in which it is located; and wherein two of said plurality of longitudinally extending conductor passageways are end longitudinal passageways and a plurality of said plurality of longitudinally extending passageways are side-by-side intermediate passageways; and wherein side walls of the jacket have a thickness smaller than an upper center wall of the jacket.

2. The cable of claim 1 wherein at least one of the plurality of twisted-pair conductors is insulated with a non-fluorinated polymer insulation.

3. The cable of claim 1 wherein each of said intermediate passageways has a different one of said plurality of twisted-pair conductors disposed therein; and wherein each of said intermediate passageways in which each of said different ones of said plurality of twisted-pair conductors is disposed encloses at least about 250° of the cylindrical envelope of each of said different twisted-pair conductors disposed in each of said intermediate passageways.

4. The cable of claim 1 wherein each of said end passageways has a different one of said plurality of twisted-pair conductors disposed therein; and wherein each of said end passageways in which each of said different ones of said twisted-pair conductors is disposed encloses at least about 305° of the cylindrical envelope of each of said different twisted-pair conductors disposed in each of said end passageways.

5. The cable of claim 1 wherein at least one of said plurality of twisted-pair conductors is joined along its length by an insulation common to each conductor of said at least one twisted pair.

6. The cable of claim 2 wherein the passageway in which the non-fluorinated polymer insulated twisted-pair conductor is disposed has thicker walls than another passageway of said longitudinally extending passageways.

7. The cable of claim 3 wherein a different one of said plurality of twisted-pair conductors is disposed in each of said end passageways and each of said end passageways in which each different one of said twisted-pair conductors is disposed encloses at least about 305° of the cylindrical envelope of said different twisted-pair conductor disposed in each of said end passageways.

8. The cable of claim 7 wherein a group of four side-by-side twisted-pair conductors is from said plurality of twisted-pair conductors, each twisted pair from said group of four has two insulated conductors, each twisted pair from said group of four has a center line;

a distance X is a distance between the center lines of adjacent twisted-pair conductors from said group of four, said distance between the center lines being when the cable is straight;

each insulated conductor of each twisted pair from said group of four twisted pairs has a diameter of not greater than 0.0395 inches;

each twisted-pair conductor of said group of four has a twisted-pair lay length of from about 0.4 to about 4.0 inches;

the relative position of each twisted-pair conductor of said group of four remains within 0.9 times X when the cable has been bent in a semi-circle along a longitudinal axis of the cable, said cable bent around a mandrel measuring 0.3 times the width of the cable; and wherein each longitudinally extending opening of said plurality of openings forms an arc angle no greater than 70° when the cable is straight.

9. The cable of claim 8 wherein said end passageways consist of a first end passageway and a second end passageway, said first end passageway has a first volume of air, said second end passageway has a second volume of air;

said intermediate passageways include a first intermediate passageway, said first intermediate passageway has a third volume of air, said first intermediate passageway adjacent to said first end passageway;

said intermediate passageways include a second intermediate passageway, said second intermediate passageway has a fourth volume of air, said second intermediate passageway adjacent to said second end passageway;

said first volume of air greater than said third volume of air;

said second volume of air greater than said fourth volume of air.

10. A flat-type communication cable for carrying frequencies in excess of 4 MHz comprising:

a plurality of longitudinally extending conductor passageways, said passageways being positioned side-by-side, the passageways including two end longitudinal conductor passageways and a plurality of side-by-side intermediate conductor passageways, each of said passageways having a longitudinally extending opening which opens to an adjacent passageway, a plurality of twisted-pair conductors, a different one of said twisted-pair conductors loosely located in each of said passageways with not more than one of said twisted-pair conductors being in each of said passageways;

each of said twisted-pair conductors having a cross-sectional envelope area less than a cross-sectional envelope area of the passageway in which each twisted-pair conductor is contained;

at least one of said intermediate passageways has two of said longitudinally extending openings; and wherein said end passageways consist of a first end passageway and a second end passageway, said first end passageway has a first volume of air, said second end passageway has a second volume of air;

said intermediate passageways include a first intermediate passageway, said first intermediate passageway has a third volume of air, said first intermediate passageway adjacent to said first end passageway;

said intermediate passageways include a second intermediate passageway, said second intermediate passageway has a fourth volume of air, said second intermediate passageway adjacent to said second end passageway;

said first volume of air greater than said third volume of air;

said second volume of air greater than said fourth volume of air.

11. The cable of claim 10 wherein a group of four side-by-side twisted-pair conductors is from said plurality of twisted-pair conductors, each twisted pair from said group of four has two insulated conductors, each twisted pair from said group of four has a center line;

a distance X is a distance between the center lines of adjacent twisted-pair conductors from said group of four, said distance between the center lines being when the cable is straight;

each insulated conductor of each twisted pair from said group of four has a diameter of not greater than 0.0395 inches;

each twisted-pair conductor of said group of four has a twisted-pair lay length of from about 0.4 to about 4.0 inches;

the relative position of each twisted-pair conductor of said group of four remains within 0.9 times X when the cable has been bent in a semi-circle along a longitudinal axis of the cable, said cable bent around a mandrel measuring 0.3 times the width of the cable; and wherein each longitudinally extending opening of said plurality of openings forms an arc angle no greater than 70° when the cable is straight.

12. The cable of claim 11 wherein the cable is unshielded;

each of said intermediate passageways has two of said longitudinally extending openings;

said end passageways consist of a first end passageway and a second end passageway, said first end passageway has a first volume of air, said second end passageway has a second volume of air;

said intermediate passageways include a first intermediate passageway, said first intermediate passageway has a third volume of air, said first intermediate passageway adjacent to said first end passageway;

said intermediate passageways include a second intermediate passageway, said second intermediate passageway has a fourth volume of air, said second intermediate passageway adjacent to said second end passageway;

said first volume of air greater than said third volume of air;

said second volume of air greater than said fourth volume of air.

13. The cable of claim 10 wherein one of said longitudinally extending passageways has thicker walls than another of said longitudinally extending passageways which has thinner walls;

a non-fluorinated polymer insulated twisted-pair conductor in said one of said passageways having the thicker walls, and said another of said passageways which has thinner walls containing a fluorinated polymer insulated twisted-pair conductor from said plurality of twisted pairs.

14. The cable of claim 12 wherein one of said longitudinally extending passageways has thicker walls than another of said longitudinally extending passageways which has thinner walls;

a non-fluorinated polymer insulated twisted-pair conductor is in said one of said passageways having the thicker walls, and said another of said passageways which has thinner walls containing a fluorinated polymer insulated twisted-pair conductor from said plurality of twisted pairs.

15. A flat-type communication cable for carrying frequencies in excess of 4 MHz comprising:

a plurality of longitudinally extending conductor passageways, said passageways being positioned side-by-side, the passageways including two end longitudinal conductor passageways and a plurality of side-by-side intermediate conductor passageways;

each of said passageways having a longitudinally extending opening which opens to an adjacent passageway;

a plurality of twisted-pair conductors, a different one of said twisted-pair conductors loosely located in each of said passageways with not more than one of said twisted-pair conductors being in each of said passageways;

each of said twisted-pair conductors having a cross-sectional envelope area less than a cross-sectional envelope area of the passageway in which each twisted-pair conductor is contained; and wherein at least one of said intermediate passageways has two of said longitudinally extending openings;

said end passageways consist of a first end passageway and a second end passageway, said first end passageway has a first volume of air, said second end passageway has a second volume of air;

said intermediate passageways include a first intermediate passageway, said first intermediate passageway has a third volume of air, said first intermediate passageway adjacent to said first end passageway;

said intermediate passageways include a second intermediate passageway, said second intermediate passageway has a fourth volume of air, said second intermediate passageway adjacent to said second end passageway;

said first volume of air greater than said third volume of air;

said second volume of air greater than said fourth volume of air;

at least one of the twisted-pair conductors is a non-fluorinated polymer insulated twisted-pair conductor; and wherein one of said longitudinally extending passageways has thicker walls than another of said longitudinally extending passageways having thinner walls;

the non-fluorinated polymer insulated twisted-pair conductor in said passageway having the thicker walls, the other passageway having the thinner walls containing a fluorinated polymer insulated twisted-pair conductor from said plurality of twisted pairs.

16. A flat-type communication cable for carrying frequencies in excess of 4 MHz comprising:

a plurality of longitudinally extending conductor passageways, said passageways being positioned side-by-side, the passageways including two end longitudinal conductor passageways and a plurality of side-by-side intermediate conductor passageways, each of said passageways having a longitudinally extending opening which opens to an adjacent passageway, a plurality of twisted-pair conductors, a different one of said twisted-pair conductors loosely located in each of said passageways with not more than one of said twisted-pair conductors being in each of said passageways;

each of said twisted-pair conductors having a cross-sectional envelope area less than a cross-sectional envelope area of the passageway in which each twisted-pair conductor is contained; and wherein at least one of said intermediate passageways has two of said longitudinally extending openings;

said end passageways consist of a first end passageway and a second end passageway, said first end passageway has a first volume of air, said second end passageway has a second volume of air;

said intermediate passageways include a first intermediate passageway, said first intermediate passageway has a third volume of air, said first intermediate passageway adjacent to said first end passageway;

said intermediate passageways include a second intermediate passageway, said second intermediate passageway has a fourth volume of air, said second intermediate passageway adjacent to said second end passageway;

said first volume of air greater than said third volume of air;

said second volume of air greater than said fourth volume of air;

at least one of the twisted-pair conductors is a non-fluorinated polymer insulated twisted-pair conductor; and wherein a group of four side-by-side twisted-pair conductors is from said plurality of twisted-pair conductors, each twisted pair from said group of four has two insulated conductors, each twisted pair from said group of four has a center line;

a distance X is a distance between the center lines of adjacent twisted-pair conductors from said group of four, said distance between the center lines being when the cable is straight;

each insulated conductor of each twisted pair from said group of four has a diameter of not greater than 0.0395 inches;

each twisted-pair conductor of said group of four has a twisted-pair lay length of from about 0.4 to about 4.0 inches;

the relative position of each twisted-pair conductor of said group of four remains within 0.9 times X when the cable has been bent in a semi-circle along a longitudinal axis of the cable, said cable bent around a mandrel measuring 0.3 times the width of the cable; and wherein each longitudinally extending opening of said plurality of openings forms an arc angle no greater than 70° when the cable is straight;

one of said longitudinally extending passageways has thicker walls than another of said longitudinally extending passageways which has thinner walls;

the non-fluorinated polymer insulated twisted-pair conductor is in said passageway having the thicker walls, the other passageway having the thinner walls containing a fluorinated polymer insulated twisted-pair conductor from said plurality of twisted pairs.

* * * * *

UNITED STATES PATENT AND TRADEMARK OFFICE

CERTIFICATE OF CORRECTION

PATENT NO. : 5,821,467
DATED : Oct. 13, 1998
INVENTOR(S) : O'Brien et al

It is certified that error appears in the above-indentified patent and that said Letters Patent is hereby corrected as shown below:

| | |
|---|---|
| Col.2, ln.25 | After "FIG. 2" insert -- showing another configuration of the present invention -- |
| Col.3, ln.22 | Delete "non-cylindrical" and insert -- cylindrical -- |
| Col.3, ln.23 | Delete "cylindrical" and insert -- non-cylindrical -- |
| Col.3, ln.54 | Delete "**75**" (bold-type) and insert --75 -- |
| Col.8, ln.52 | Insert "is" between --air-- and --greater-- |
| Col.8, ln.54 | Insert "is" between --air-- and --greater-- |
| Col.9, ln.29 | Insert "is" between --air-- and --greater-- |
| Col.9, ln.31 | Insert "is" between --air-- and --greater-- |
| Col.11, ln.4 | Insert "is" between --air-- and --greater-- |
| Col.11, ln.6 | Insert "is" between --air-- and --greater-- |
| Col. 12, ln 22 | Insert omitted new claims 17, 18 and 19 as follows: |

--17. The cable of claim 12 wherein each of said intermediate passageways in which each of said different ones of said plurality of twisted-pair conductors is disposed encloses at least about 250° of the cylindrical envelope of each of said different twisted-pair conductors disposed in each of said intermediate passageways.--

UNITED STATES PATENT AND TRADEMARK OFFICE

CERTIFICATE OF CORRECTION

PATENT NO. : 5,821,467
DATED : Oct. 13, 1998
INVENTOR(S) : O'Brien et al

It is certified that error appears in the above-identified patent and that said Letters Patent is hereby corrected as shown below:

18. The cable of claim 12 wherein each of said end passageways in which each of said different ones of said twisted-pair conductors is disposed encloses at least about 305° of the cylindrical envelope of each of said different twisted-pair conductors disposed in each of said end passageway.

UNITED STATES PATENT AND TRADEMARK OFFICE

CERTIFICATE OF CORRECTION

PATENT NO. : 5,821,467

DATED : October 13, 1998

INVENTOR(S) : O'Brien, et al.

It is certified that error appears in the above-identified patent and that said Letters Patent is hereby corrected as shown below:

19. The cable of claim 20 wherein each of said end passageways in which each of said different ones of said twisted-pair conductors is disposed encloses at least about 305° of the cylindrical envelope of each of said different twisted-pair conductors disposed in each of said end passageways.

Signed and Sealed this

Eleventh Day of May, 1999

*Attest:*

Q. TODD DICKINSON

*Attesting Officer*

*Acting Commissioner of Patents and Trademarks*